US011581119B2

(12) United States Patent
Song et al.

(10) Patent No.: US 11,581,119 B2
(45) Date of Patent: Feb. 14, 2023

(54) MAGNETIC DEVICE AND METHOD OF MANUFACTURING THE SAME

(71) Applicant: Delta Electronics (Shanghai) CO., LTD, Shanghai (CN)

(72) Inventors: Haibin Song, Shanghai (CN); Qi Fu, Shanghai (CN); Daofei Xu, Shanghai (CN); Jinfa Zhang, Shanghai (CN)

(73) Assignee: Delta Electronics (Shanghai) CO., LTD, Shanghai (CN)

( * ) Notice: Subject to any disclaimer, the term of this patent is extended or adjusted under 35 U.S.C. 154(b) by 489 days.

(21) Appl. No.: 16/740,554

(22) Filed: Jan. 13, 2020

(65) Prior Publication Data

US 2020/0251272 A1 Aug. 6, 2020

(30) Foreign Application Priority Data

Jan. 15, 2019 (CN) ..... 201910037342.3

(51) Int. Cl.
*H01F 27/24* (2006.01)
*H01F 27/28* (2006.01)
*H01F 41/02* (2006.01)

(52) U.S. Cl.
CPC ..... *H01F 27/24* (2013.01); *H01F 27/2823* (2013.01); *H01F 41/02* (2013.01)

(58) Field of Classification Search
CPC ..... H01F 27/24; H01F 27/2823; H01F 41/02; H01F 3/14; H01F 27/346; H01F 3/10;
(Continued)

(56) References Cited

U.S. PATENT DOCUMENTS 4,665,357 A 5/1987 Herbert
D330,541 S 10/1992 Burrow et al.
(Continued)

FOREIGN PATENT DOCUMENTS

CN 85103560 A 10/1985
CN 2476085 Y 2/2002
(Continued)

OTHER PUBLICATIONS

The 2nd Office Action dated Apr. 16, 2021 from CN patent application No. 201910037335.3.
(Continued)

*Primary Examiner* — Lincoln D Donovan
*Assistant Examiner* — Alex W Lam
(74) *Attorney, Agent, or Firm* — Qinghong Xu

(57) ABSTRACT

A magnetic device comprises two base portions and magnetic pillars, wherein each of the two base portions has a first surface and the two first surfaces are faced to each other, and the magnetic pillars are disposed between the two first surfaces along a first direction, wherein, in the first direction, two of the magnetic pillars located at the outermost side of the base portion are a first corner pillar and a second corner pillar respectively, n of the magnetic pillars having the same cross-sectional area and located at the center position of the base portion are n center pillars, and cross-sectional area of the magnetic pillars are gradually increased from the first corner pillar to the center pillar closest to the first corner pillar, and from the second corner pillar to the center pillar closest to the second corner pillar.

23 Claims, 19 Drawing Sheets

(58) Field of Classification Search
CPC .... H01F 27/306; H01F 27/28; H01F 27/2871; H01F 2027/2838; H01F 2027/2842; H01F 2027/2861; H01F 2027/2857
See application file for complete search history.

(56) References Cited

U.S. PATENT DOCUMENTS

| | | | | |
|---|---|---|---|---|
| 5,631,618 | A | 5/1997 | Trumper et al. | |
| D463,365 | S | 9/2002 | Sakai et al. | |
| D539,220 | S | 3/2007 | Iwakura | |
| 7,311,140 | B2 | 12/2007 | McCullough | |
| D616,380 | S | 5/2010 | Chang et al. | |
| 7,839,255 | B2 | 11/2010 | Nagano et al. | |
| 8,009,001 | B1 | 8/2011 | Cleveland | |
| D645,829 | S | 9/2011 | Yu | |
| D657,311 | S | 4/2012 | Chan | |
| D682,208 | S | 5/2013 | Kobayashi | |
| 2003/0106670 | A1 | 6/2003 | Lee et al. | |
| 2004/0244636 | A1 | 12/2004 | Meadow et al. | |
| 2005/0024179 | A1* | 2/2005 | Chandrasekaran | H01F 27/24 336/212 |
| 2007/0273465 | A1 | 11/2007 | Feng et al. | |
| 2013/0313511 | A1* | 11/2013 | Kim | H01L 27/228 257/E25.003 |
| 2016/0276087 | A1 | 9/2016 | Yan et al. | |
| 2016/0307695 | A1 | 10/2016 | Jitaru | |
| 2018/0069117 | A1* | 3/2018 | Cho | H01L 27/10876 |
| 2018/0085786 | A1 | 3/2018 | Songatikamas et al. | |
| 2018/0226182 | A1* | 8/2018 | Fe | H02M 3/33523 |
| 2019/0272936 | A1* | 9/2019 | Zhang | H01L 28/10 |
| 2020/0251272 | A1 | 8/2020 | Song et al. | |

FOREIGN PATENT DOCUMENTS

| | | | |
|---|---|---|---|
| CN | 2572525 | Y | 9/2003 |
| CN | 201430055 | Y | 3/2010 |
| CN | 202905387 | U | 4/2013 |
| CN | 204668095 | U | 9/2015 |
| CN | 106057433 | A | 10/2016 |
| CN | 106971829 | A | 7/2017 |
| CN | 207116197 | U | 3/2018 |
| CN | 108777220 | A | 11/2018 |
| JP | H0878254 | A | 3/1996 |
| JP | 2001023830 | A | 1/2001 |
| JP | 2007311397 | A | 11/2007 |

OTHER PUBLICATIONS

Notice of Allowance dated Jul. 21, 2021 for CN patent application No. 20191003733533.

The CN1OA dated Nov. 18, 2020 by the CNIPA from application No. 201910037335.3.

The CN1OA dated Nov. 24, 2020 by the CNIPA from application No. 201910037342.3.

"Soft Ferrite Core". Found online Oct. 23, 2020 at indiamart.com. Reference dated Mar. 10, 2010. Retrieved from https://tineye.com/search/ae7d4b 173442a81717306d8a464aa7fcd848843c?sort=crawl_date&order=asc&page= 1. (Year: 2010).

"Ferrite Core High Frequency Transformer". Found online Oct. 29, 2020 at alibaba.com. Reference dated Jul. 3, 2018. Retrieved from https ://tineye.com/search/23c23b1362d21e7b6c4ab29e22042daaef269245?sort=crawl_date&order=asc&page= 1. (Year: 2018).

"LoveRPi Performance Heatsink". Found online Oct. 30, 2020 at amazon.com. Reference dated Nov. 21, 2015. Retrieved from https ://www.amazon.com/LoveRPi-Performance-Heatsink-Set-Raspberry/dp/B018BGRDVS/ref=psdc_2998409011_t2_B07W1HHTXD. (Year: 2015).

The USNOA dated Nov. 12, 2020 by the USPTO from U.S. Appl. No. 29/697,318.

* cited by examiner

MAGNETIC DEVICE AND METHOD OF MANUFACTURING THE SAME

CROSS REFERENCE

The present application is based upon and claims priority to Chinese Patent Application No. 201910037342.3, filed on Jan. 15, 2019, the entire contents of which are incorporated herein by reference.

TECHNICAL FIELD

The present disclosure relates to a magnetic device and a method of manufacturing the magnetic device.

BACKGROUND

With the development trend of miniaturization of switching mode power supplies, high-frequency design becomes popular, as a consequence, loss of magnetic components which impacts efficiency greatly becomes more prominent. The calculation of the magnetic loss per unit volume can be based on the Steinmets empirical formula:

$$P_v=C_m \cdot C_T \cdot f^{\alpha} \cdot B^{\beta}$$

Wherein, $C_m$, $\alpha$ and $\beta$ are constants associated with the material, $C_T$ is the temperature coefficient associated with the material, f is the switching frequency, and B is the magnetic flux density.

In high-frequency design, in order to reduce magnetic loss, on the one hand, it is necessary to actively seek new magnetic material with smaller $\alpha$ and $\beta$ values, and on the other hand, the magnetic loss can be reduced by smaller B value design.

For the above purpose, a four-pillar magnetic core structure has been developed in the industry. As shown in FIG. 1, in the U-shape core, the magnetic flux of the base portion are equal with the magnetic flux of the magnetic pillar, while in the four-pillar magnetic core structure, the magnetic flux of the magnetic pillars respectively flows from (or to) two directions perpendicular to each other, and the magnetic flux of the base portion is halved, thereby reducing the magnetic flux density and reducing the magnetic loss.

However, referring to FIG. 1, although the four-pillar magnetic core can reduce the magnetic loss of the base portion 10, it has its limitations. On the one hand, the magnetic flux of the base portion 10 is only half of the magnetic flux of the magnetic pillar 111. When the magnetic flux of the magnetic pillar 111 is larger, a thicker base portion 10 is still required to maintain a lower magnetic flux density to reduce magnetic loss, which is disadvantageous for the design with ultra-low profile. On the other hand, from the simulation results, the magnetic flux of the base portion 10 and the magnetic pillar 111 is not even. The uneven distribution of the magnetic flux will cause an increase of magnetic loss. This effect is not critical with low-frequency design. However, with high frequency design, the evenness of the magnetic flux is quite critical to reduce the magnetic loss.

The above described information is only for enhancement of understanding of the background of the present disclosure, therefore it may comprise information that does not constitute prior art known to those skilled in the art.

SUMMARY

The present disclosure provides a magnetic device, the base portion of which has an even magnetic flux distribution.

The present disclosure also provides a method of manufacturing the magnetic device, the base portion of which has an even magnetic flux distribution.

According to an aspect of the disclosure, a magnetic device is provided, which comprises: two base portions, wherein each of the two base portions has a first surface and the two first surfaces of the two base portions are faced to each other, and a plurality of magnetic pillars, disposed between the two first surfaces of the two base portions along a first direction, wherein, in the first direction, two of the magnetic pillars located at the outermost side of the base portion are a first corner pillar and a second corner pillar respectively, n of the magnetic pillars having the same cross-sectional area and located at the center position of the base portion are n center pillars, and the n center pillars constitute a center pillar unit, m of the magnetic pillars located between the first corner pillar and the center pillar unit are first middle pillars which constitute a first middle pillar unit, and m of the magnetic pillars located between the second corner pillar and the center pillar unit are second middle pillars which constitute a second middle pillar unit, wherein n is an integer greater than or equal to 1, m is an integer greater than or equal to zero, and cross-sectional area of the magnetic pillars are gradually increased from the first corner pillar to the center pillar closest to the first corner pillar, and from the second corner pillar to the center pillar closest to the second corner pillar.

According to another aspect of the disclosure, a method of manufacturing a magnetic device is provided, which comprises: providing a magnetic core, wherein the magnetic core comprises: two base portions, wherein each of the two base portions has a first surface and the two first surfaces of the two base portions are faced to each other, and a plurality of magnetic pillars, disposed between the two first surfaces of the two base portions along a first direction, wherein, in the first direction, two of the magnetic pillars located at the outermost side of the base portion are a first corner pillar and a second corner pillar respectively, n of the magnetic pillars having the same cross-sectional area and located at the center position of the base portion are n center pillars, and the n center pillars constitute a center pillar unit, m of the magnetic pillars located between the first corner pillar and the center pillar unit are first middle pillars which constitute a first middle pillar unit, and m of the magnetic pillars located between the second corner pillar and the center pillar unit are second middle pillars which constitute a second middle pillar unit, wherein n is an integer greater than or equal to 1, m is an integer greater than or equal to zero, and cross-sectional area of the magnetic pillars are gradually increased from the first corner pillar to the center pillar closest to the first corner pillar, and from the second corner pillar to the center pillar closest to the second corner pillar.

DETAILED DESCRIPTION

Figure 1:
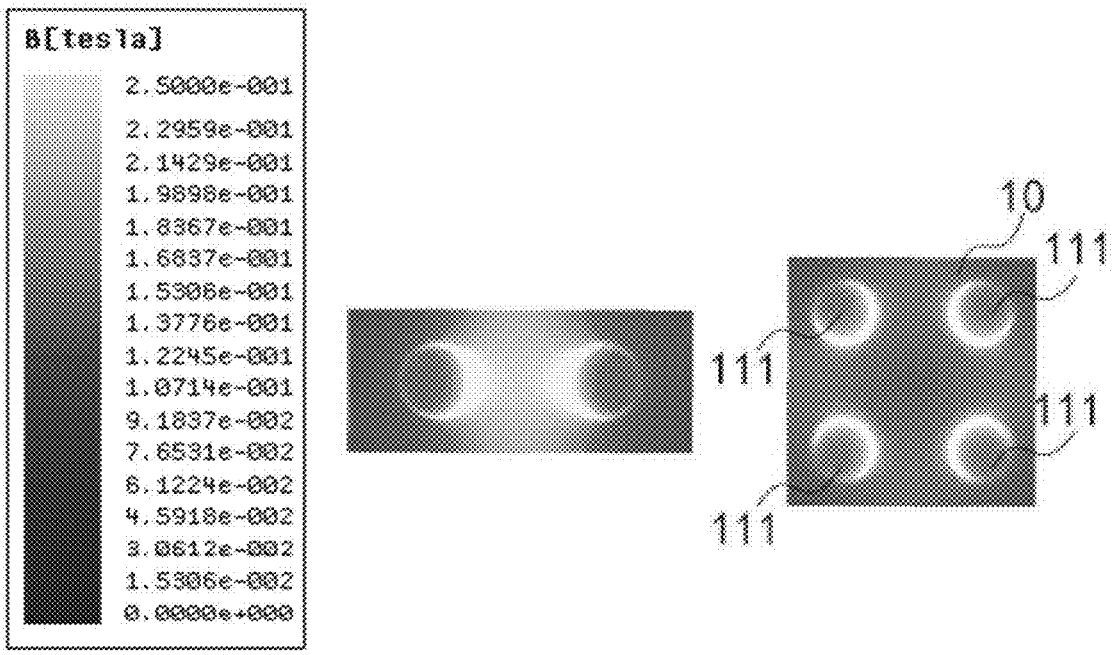
FIG. 1 is a schematic view of magnetic flux simulation results of base portions of a U-shaped magnetic core and a four-pillar magnetic core under the same condition.

Various embodiments will be described more comprehensive with reference to the accompanying drawings. However, the one or more embodiments can be implemented in many manners, and should not be construed as being limited to the embodiments set forth herein. Oppositely, these embodiments are provided so that the present disclosure will be more comprehensive and complete, and the concept of the one or more embodiments is comprehensively conveyed to those skilled in the art. The same reference numerals in the accompanying drawings are denoted the same or similar structures, thereby their detailed description will be omitted. In addition, the "parallel" and "equal" mentioned in the specification is not absolute, but allows an error of about 20%.

Generally speaking, the magnetic device of the present disclosure comprises two base portions and a plurality of magnetic pillars. Each of the two base portions has a first surface and the two first surfaces of the two base portions that are faced to each other. The plurality of magnetic pillars are disposed between the two first surfaces along a first direction. In the embodiment, in the first direction, the two magnetic pillars located at the outermost side of the base portion are a first corner pillar and a second corner pillar, respectively. The n magnetic pillars having the same cross-sectional area and located at the center position of the base portion are n center pillars. The n center pillars constitute a center pillar unit. m of the magnetic pillars located between the first corner pillar and the center pillar unit are first middle pillars which constitute a first middle pillar unit, and m of the magnetic pillars located between the second corner pillar and the center pillar unit are second middle pillars which constitute a second middle pillar unit, wherein n is an integer greater than or equal to 1, m is an integer greater than or equal to zero. The cross-sectional area of the magnetic pillars are gradually increased from the first corner pillar to the center pillar closest to the first corner pillar, and from the second corner pillar to the center pillar closest to the second corner pillar.

Figure 2A:
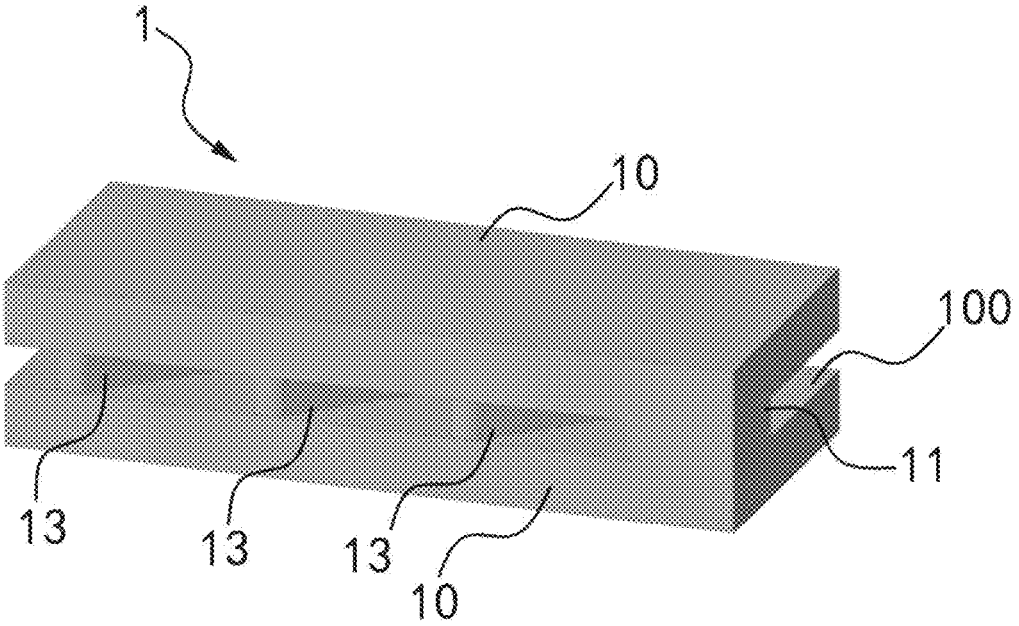
FIG. 2A is a structure schematic view of a magnetic core in an embodiment of the magnetic device of the present disclosure.
Figure 2B:
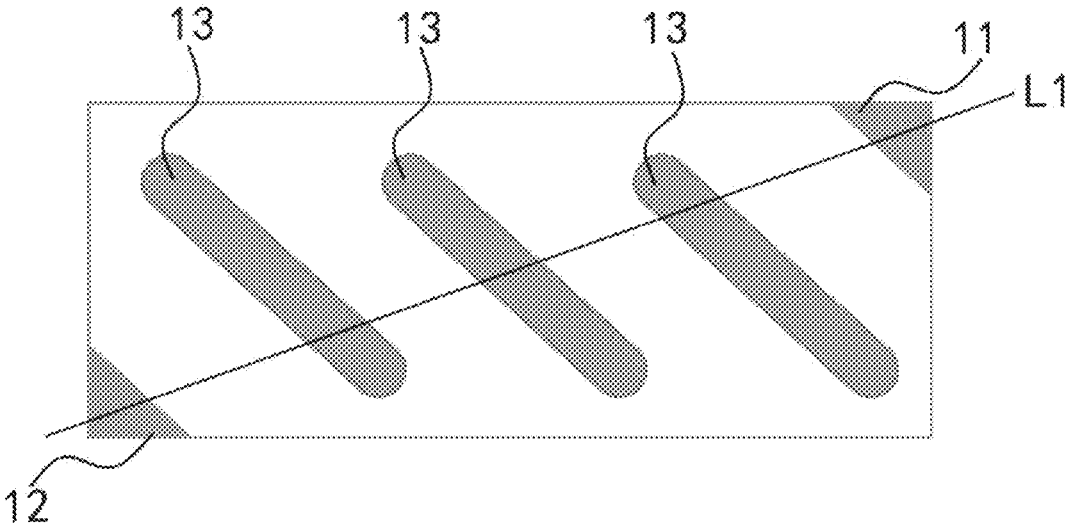
FIG. 2B is a cross-sectional view of the magnetic device shown in FIG. 2A.

Referring to FIGS. 2A and 2B, FIG. 2A is a structure schematic view of a magnetic core in an embodiment of the magnetic device of the present disclosure. FIG. 2B is a cross-sectional view of the magnetic device shown in FIG. 2A. The magnetic device of the present disclosure comprises a magnetic core 1. Generally speaking, the magnetic core 1 comprises two oppositely disposed base portions 10 and a plurality of magnetic pillars. Each of the two base portions 10 has a first surface 100 and the two first surfaces 100 of the two base portions 10 are faced to each other. The plurality of magnetic pillars are disposed between the two first surfaces 100 and arranged along a first direction L1, which can be referring to FIG. 2B.

In the embodiment, in the first direction L1, the two magnetic pillars located at the outmost side are a first corner pillar 11 and a second corner pillar 12, respectively. The three magnetic pillars with the same cross-sectional area and located at the center position of the base portion 10 are center pillars 13. That is, in the first direction, the first corner pillar 11, the three center pillars 13, and the second corner pillar 12 are sequentially arranged, wherein the first direction is a direction L1 of the connecting line between the first corner pillar 11 and the second corner pillar 12.

Figure 3A:
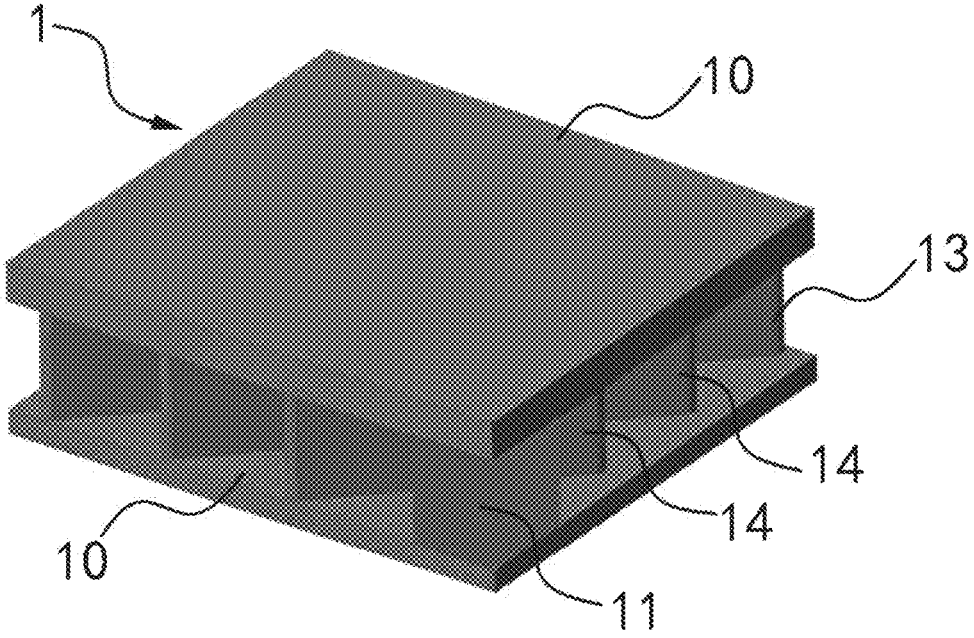
FIG. 3A is a structure schematic view of a magnetic core in an embodiment of the magnetic device of the present disclosure.
Figure 3B:
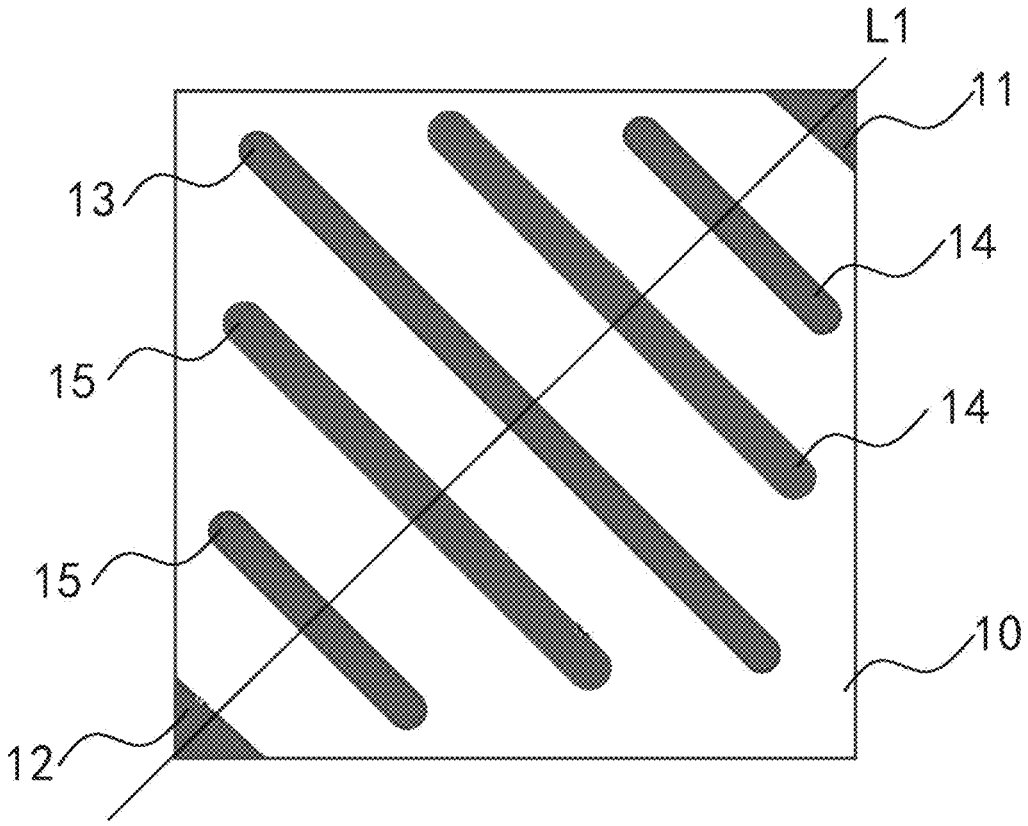
FIG. 3B is a cross-sectional view of the magnetic device shown in FIG. 3A.

Moreover, the area of the respective magnetic pillars on a section (i.e., a cross section) paralleled to the first surface 100 have the following rule: the cross-sectional area are gradually increased from the first corner pillar 11 to the center pillar 13 closest to the first corner pillar 11 and from the second corner pillar 12 to the center pillar 13 closest to the second corner pillar 12. Preferably, the area may be varied in an arithmetic progression with the same difference, and the difference is the cross-sectional area of the first corner pillar 11 or the second corner pillar 12, wherein the cross-sectional area of the first corner pillar 11 and the second corner pillar 12 are equal. In detail, supposing that the cross-sectional area of both the first corner pillar 11 and the second corner pillar 12 is S, the cross-sectional area of all of the three center pillars 13 is 2S. Referring to FIG. 3A and FIG. 3B, FIG. 3A is a structure schematic view of a magnetic core in an embodiment of the magnetic device of the present disclosure. FIG. 3B is a cross-sectional view of the magnetic device shown in FIG. 3A. As shown in FIG. 3A and FIG. 3B, in the embodiment, along the first direction L1 (referring to FIG. 3B), the two magnetic pillars located at the outermost side of the base portion 10 are the first corner pillar 11 and the second corner pillar 12, respectively. The magnetic pillar located at the center position of the base portion 10 is the center pillar 13. The two magnetic pillars located between the first corner pillar 11 and the center pillar 13 are the first middle pillars 14. The two magnetic pillars located between the second corner pillar 12 and the center pillar 13 are the second middle pillars 15. That is, in the first direction L1, the first corner pillar 11, the two first middle pillars 14, the center pillar 13, the two second middle pillars 15 and the second corner pillar 12 are sequentially arranged. Different from the embodiment shown in FIG. 2A and FIG. 2B, the embodiment shown in FIG. 3A and FIG. 3B further comprises the first middle pillars 14 and the second middle pillars 15.

Similarly, the cross-sectional area of the respective magnetic pillars on a section paralleled to the first surface 100 have the following rule: the cross-sectional area of the magnetic pillars are gradually increased from the first corner pillar 11 to the center pillar 13 closest to the first corner pillar 11 and from the second corner pillar 12 to the center pillar 13 closest to the second corner pillar 12. Preferably, the cross-sectional area may be varied in an arithmetic progression with the same difference, and the difference is the cross-sectional area of the first corner pillar 11 or the second corner pillar 12, wherein the cross-sectional area of the first corner pillar 11 and the second corner pillar 12 is equal. In detail, supposing that the cross-sectional area of both the first corner pillar 11 and the second corner pillar 12 is S, the cross-sectional area of the two first middle pillars 14 close to the first corner pillar 11 are 2S and 3S, respectively. The cross-sectional area of the two second middle pillars 15 close to the second corner pillar 12 are 2S and 3S, respectively, and the cross-sectional area of the center pillar 13 is 4S.

Figure 5:
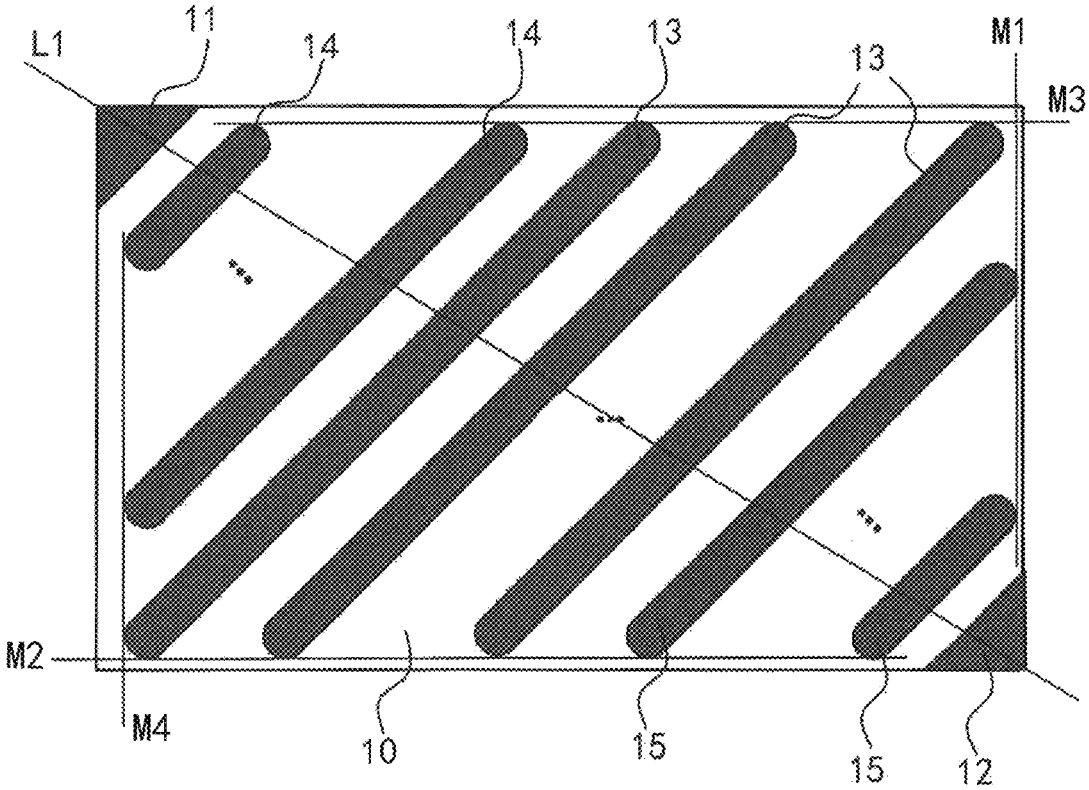
FIG. 5 is a schematic view of the arrangement of magnetic pillars in a magnetic device with 2(m+n/2+1) magnetic pillars.

Referring to FIG. 5, FIG. 5 is a schematic view of the arrangement of magnetic pillars in a magnetic device having 2(m+n/2+1) magnetic pillars. In the embodiment, in the first direction L1, the two magnetic pillars located at the outmost side are the first corner pillar 11 and the second corner pillar 12, respectively. The n magnetic pillars located at the center position of the base portion 10 are the n center pillars 13. The n center pillars 13 constitute a center pillar unit. The m magnetic pillars located between the first corner pillar 11 and the center pillar unit are the first middle pillars 14. The m magnetic pillars located between the second corner pillar 12 and the center pillar unit are the second middle pillars 15.

The cross-sectional area of the respective magnetic pillars on a section paralleled to the first surface 100 have the following rule: the cross-sectional area are gradually increased from the first corner pillar 11 to the center pillar 13 closest to the first corner pillar 11 and from the second corner pillar 12 to the center pillar 13 closest to the second corner pillar 12. Preferably, the area may be varied in an arithmetic progression with the same difference, and the difference is the cross-sectional area of the first corner pillar 11 or the second corner pillar 12, wherein the cross-sectional area of the first corner pillar 11 and the second corner pillar 12 are equal. Further, when the cross-sectional area of both the first corner pillar 11 and the second corner pillar 12 is S, the cross-sectional area of the $k^{th}$ first middle pillar 14 close to the first corner pillar 11 is (k+1)*S, and the cross-sectional area of the $k^{th}$ second middle pillar 15 close to the second corner pillar 12 is (k+1)*S, and the cross-sectional area of each of the center pillars 13 is (m+2)*S. In the embodiment, n is an integer greater than or equal to 1, and m and k are integers greater than or equal to zero.

For the embodiment of the magnetic device shown in FIG. 2A, m=0, and n=3, that is, the number of the first middle pillar and the second middle pillar is zero, and the magnetic device shown in FIG. 2A only comprises the first corner pillar 11, the second corner pillar 12 and the center pillars 13. For the embodiment of the magnetic device shown in FIG. 3A, m=2, and n=1, that is, the magnetic core comprises a center pillar 13, a first corner pillar 11, a second corner pillar 12, two first middle pillars 14 and two second middle pillars 15. However, the present disclosure is not limited thereto, as long as m is an integer greater than or equal to 0, and n is an integer greater than or equal to 1.

In an embodiment of the present disclosure, as shown in FIG. 5, in a cross section paralleled to the first surface 100, the cross-sectional shape of both the first corner pillar 11 and the second corner pillar 12 are triangular. The cross-sectional shape of all of the first middle pillars 14, the center pillars 13 and the second middle pillars 15 are racetrack shape. The present disclosure is not limited thereto. In some other embodiments, the cross-sectional shapes of the first corner pillar 11 and the second corner pillar 12 may be other shapes such as a circle, a semicircle, an ellipse, a rectangle, and the like, as well. The cross-sectional shapes of the first corner pillar 11 and the second corner pillar 12 may be the same, or may be different. The cross-sectional shapes of the center pillars 13, the first middle pillars 14 and the second middle pillars 15 may be elliptical, racetrack or rectangular, and the like, as well. The shapes of the center pillars 13, the first middle pillars 14, and the second middle pillars 15 may be the same, or may be different.

In an embodiment of the present disclosure, as shown in FIG. 5, the widths of the first middle pillars 14, the center pillars 13 and the second middle pillars 15 are the same, and the respective longitudinal centerlines are paralleled to each other and equally spaced apart from each other to facilitate the arrangement of the magnetic pillars. In the embodiment, the direction of the longitudinal centerline is intersected with the first direction L1. However, the present disclosure is not limited thereto, and the arrangement manner of the respective magnetic pillars may be adjusted according to specific applications, as long as the cross-sectional area of the respective magnetic pillars are followed the above rule in the first direction L1. For example, the width of the center pillar 13 may be smaller than the widths of the first middle pillars 14 or the second middle pillars 15, and the widths of the plurality of center pillars 13 may be inconsistent.

Further, in an embodiment of the present disclosure, as shown in FIG. 5, all the magnetic pillars of the magnetic core are divided into two symmetrical parts by the center pillars 13. Each of the elongated center pillars 13, first middle pillars 14 and second middle pillars 15 has a first end and a second end in the direction along its longitudinal centerline. The first ends of the second middle pillars 15 located on one side of the center pillars 13 are located on the first straight line M1, and the second ends thereof are located on the second straight line M2. The first ends of the first middle pillars 14 located at the other side of the center pillars 13 are located on the fourth straight line M4, and the second ends thereof are located on the third straight line M3. The first ends and the second ends of the center pillars 13 are located on the second straight line M2 and the third straight line M3, respectively. The first straight line M1, the second straight line M2, the third straight line M3 and the fourth straight line M4 may intersect end to end to form a quadrilateral, such as a rectangle, a square, or the like. Therefore, when the base portion 10 is disposed to be rectangular or square with reference to the above-described quadrilateral, the area of the base portion 10 can be reduced, and the volume of the magnetic core can be further reduced. It should be noted that the present disclosure is not limited thereto, and the area of the base portion 10 may be larger than the above-described quadrilateral, and the shape of the base portion 10 may be circular or the like.

Compared to the U-shaped magnetic core, when the magnetic cores of the present disclosure use a reasonable winding method, the magnetic loss and the magnetic flux density of the base portions 10 can be further reduced.

Figure 6:
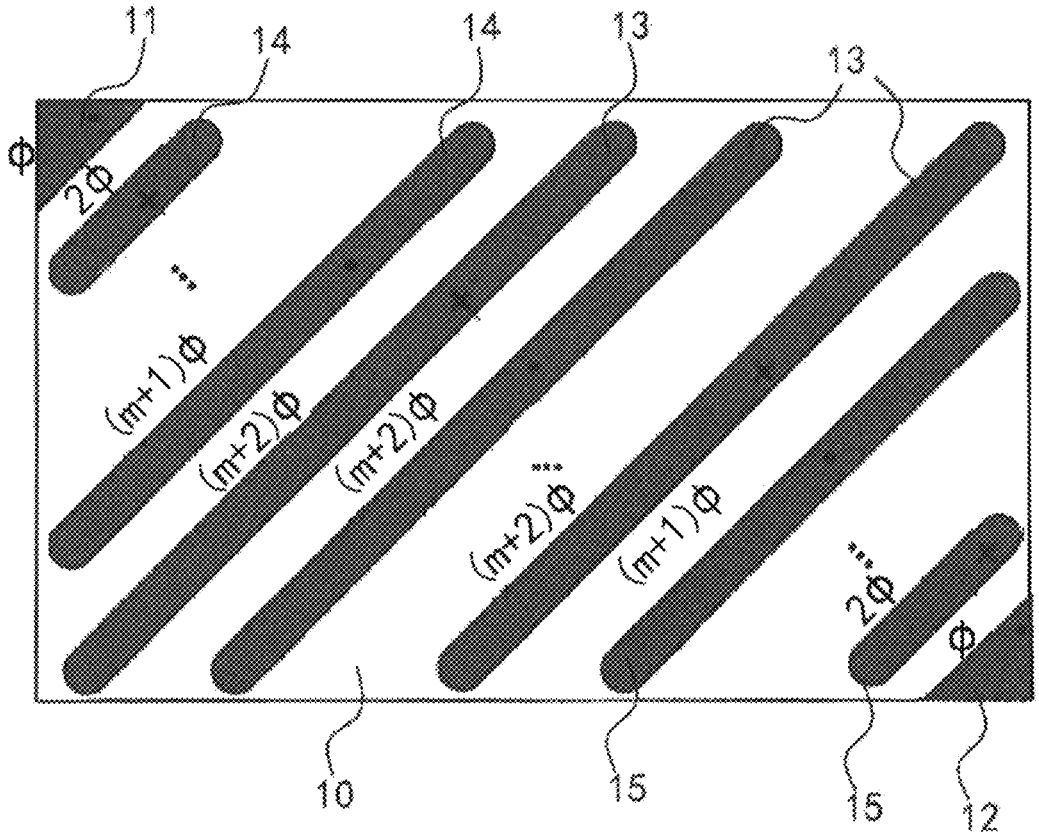
FIG. 6 is a schematic view of the magnetic flux principle of the magnetic device shown in FIG. 5.

FIG. 6 is a schematic view of the magnetic flux principle of the magnetic device shown in FIG. 5. Referring to FIG. 6, in order to make the magnetic flux of the magnetic device more even, magnetic flux directions of adjacent magnetic pillars may be oppositely disposed, and the magnetic flux of the respective magnetic pillars follows the following rule: the magnetic flux of the first corner pillar 11 and the magnetic flux of the second corner pillar 12 is equal, the magnetic flux from the first corner pillar 11 to the center pillar 13 closest to the first corner pillar 11 and the magnetic flux from the second corner pillar 12 to the center pillar 13 closest to the second corner pillar 12 is varied in an arithmetic progression with the same difference, and the difference is the magnetic flux of the first corner pillar 11 or the second corner pillar 12. Further, supposing that the magnetic flux of both the first corner pillar 11 and the second corner pillar 12 is $\varphi$, the magnetic flux of the $k^{th}$ first middle pillar 14 close to the first corner pillar 11 is $(k+1)*\varphi$, the magnetic flux of the $k^{th}$ second middle pillar 15 close to the second corner pillar 12 is $(k+1)*\varphi$, and the magnetic flux of each of the center pillars 13 is $(m+2)*\varphi$. In this way, on the one hand, the evenness of the magnetic flux of the magnetic core can be improved, thereby effectively reducing the magnetic loss, and on the other hand, the magnetic flux of the base portion of the magnetic core can be reduced, thereby it is possible to reduce the thickness of base portion of the magnetic core without increasing the magnetic flux density of the base portion, such that the height of the magnetic core and the weight of the magnetic device can be effectively reduced, thus it is very suitable for the design of ultra-low profile and the design of lightweight structure.

Figure 4A:
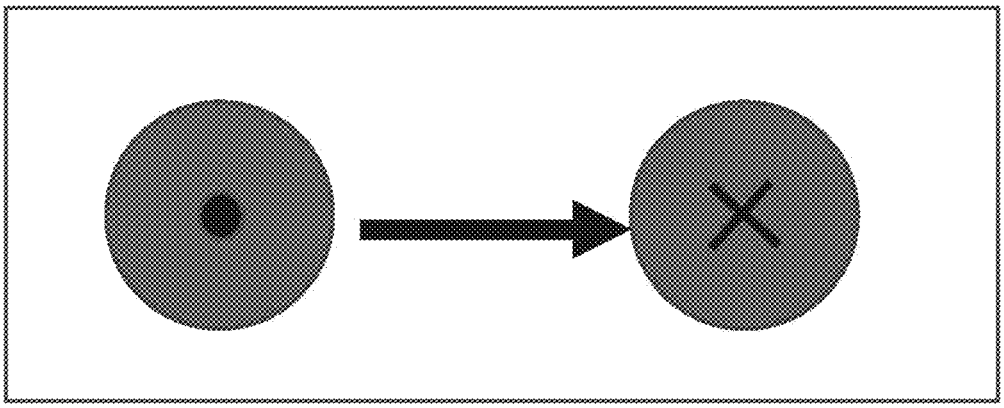
FIG. 4A is a schematic view of a magnetic flux principle of a magnetic device with a U-shaped magnetic core.
Figure 4B:
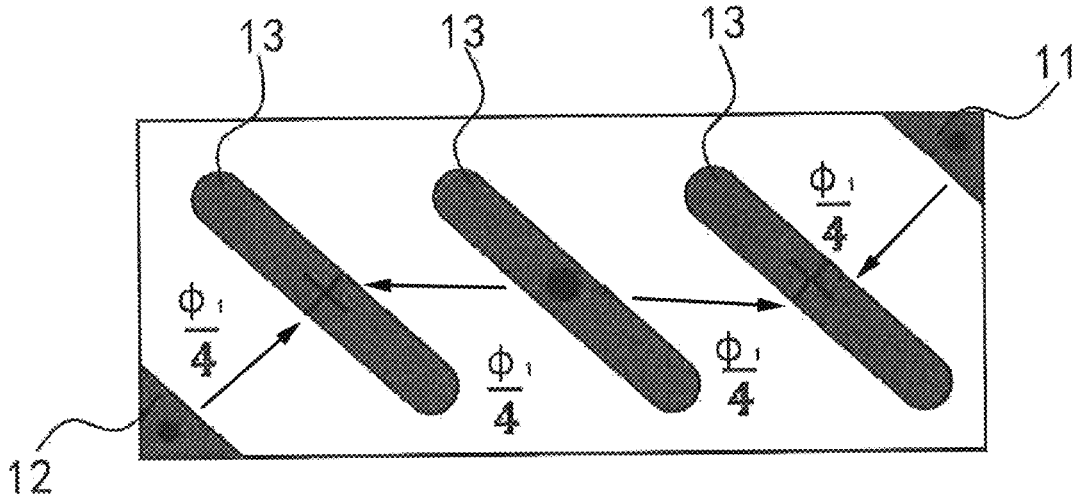
FIG. 4B is a schematic view of a magnetic flux principle of the magnetic device shown in FIG. 2A.
Figure 4C:
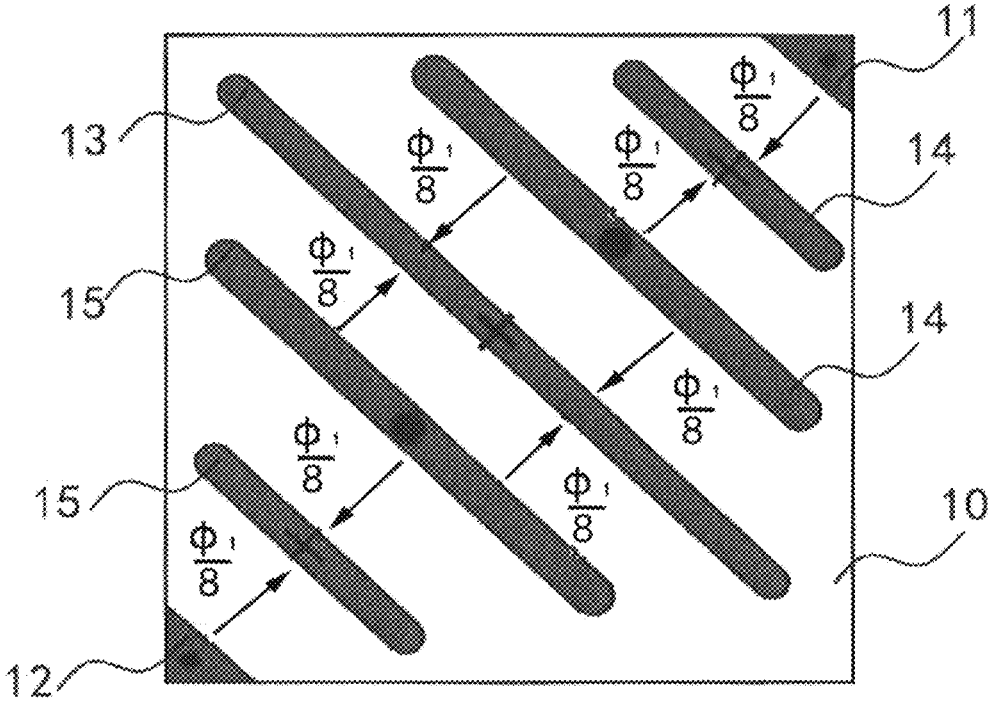
FIG. 4C is a schematic view of a magnetic flux principle of the magnetic device shown in FIG. 3A.

Particularly, referring to FIG. 4B and FIG. 4C, FIG. 4B and FIG. 4C show the distribution of magnetic flux in the magnetic device including the magnetic core shown in FIGS. 2A and 3A. Through a reasonable design of the first coil, the magnetic flux directions of adjacent magnetic pillars are opposite to each other, and the magnetic flux of the magnetic pillar follows the above described rule.

As shown in FIG. 4B and FIG. 4C, the symbol "●" indicates that the magnetic flux direction is vertical to the paper and toward the outside, the symbol "X" indicates that the magnetic flux direction is vertical to the paper and toward the inner side, and the two directions are opposite to each other. It can be seen from FIG. 4B and FIG. 4C that the magnetic flux of each magnetic pillar comes from or flows to one or two magnetic pillars adjacent to it. For example, as shown in FIG. 4B, the magnetic flux of the first corner pillar 11 and the second corner pillar 12 is respectively flowed to the adjacent center pillar 13. The magnetic flux of the first center pillar 13 closest to the first corner pillar 11 comes from the first corner pillar 11 and the other center pillar 13 adjacent to it, respectively.

As shown in FIG. 4A, in the conventional U-shaped magnetic core, supposing that the cross-sectional area of each of the two middle pillars is S1, and the magnetic flux passing through it is $\varphi_1$. In the case where the total cross-sectional area of the middle pillars is kept constant and the total magnetic flux passing through the middle pillars is constant, one of the middle pillars is split into two magnetic pillars each with a cross-sectional area of $S_1/2$, and the magnetic flux passing through each of them is $\varphi_1/2$. The other middle pillar is split into three magnetic pillars respectively with cross-sectional area of $S_1/4$, $S_1/2$ and $S_1/4$, and the magnetic flux passing through them respectively is ($\varphi_1/4$, $\varphi 1/2$ and $\varphi_1/4$. Then the five magnetic pillars are arranged as shown in FIG. 4B. It can be seen that the total cross-sectional area and magnetic flux density of the magnetic pillars are the same as those of the conventional U-shaped magnetic core, but the magnetic flux of the base portion is reduced to ¼ of the U-shaped magnetic core. Therefore, the design is advantageous for reducing the magnetic flux density of the base portion of the magnetic device, and is advantageous for reducing the magnetic loss and thickness of the base portion, and is suitable for the design of the ultra-thin magnetic component and the design of the lightweight structure.

Figure 7:
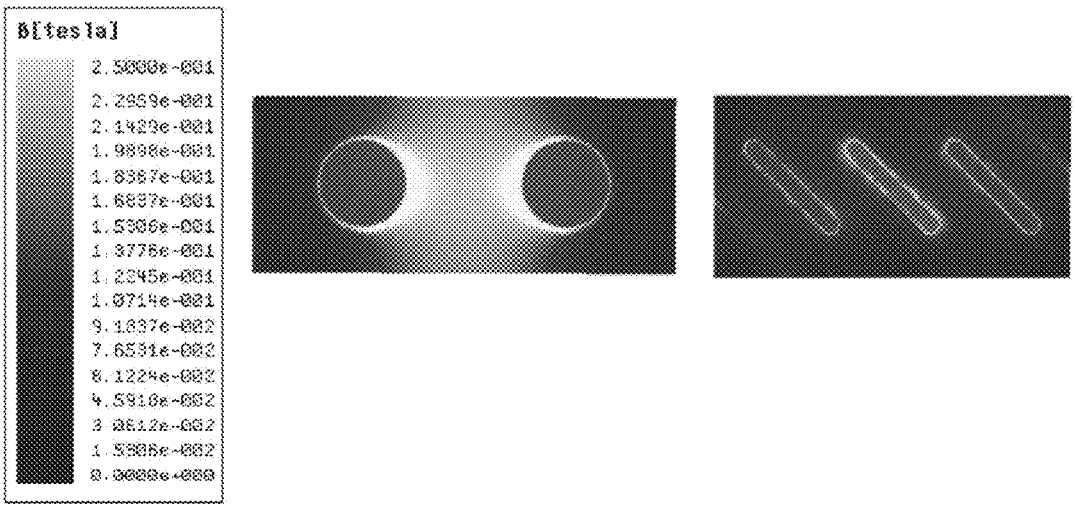
FIG. 7 is a schematic view of magnetic flux simulation results of base portions of the magnetic device shown in FIG. 2A and a magnetic device with a U-shaped magnetic core under the same condition.

Referring to FIG. 7. FIG. 7 is a schematic view of magnetic flux simulation results of base portions of the magnetic device shown in FIG. 2A and a magnetic device with a U-shaped magnetic core under the same condition. As shown in the simulation results of FIG. 7, comparing with the conventional U-shaped magnetic device, the magnetic loss of the base portion 10 of the magnetic device of the present disclosure is significantly reduced, and the magnetic flux evenness of the base portion 10 and the magnetic pillar is further improved.

Similarly, for FIG. 4C, compared with the conventional U-shaped magnetic core as well, supposing that the cross-sectional area of the middle pillar of the conventional U-shaped magnetic core is $S_1$, and the magnetic flux passing through it is $\varphi_1$. In the case where the total cross-sectional area of the middle pillars is kept constant and the total magnetic flux passing through them is constant, one of the center pillars of the conventional U-shaped magnetic core is split into four magnetic pillars respectively with sectional areas of $S_1/8$, $3S_1/8$, $3S_1/8$ and $S_1/8$, the magnetic flux passing through them respectively is $\varphi_1/8$, $3\varphi_1/8$, $3\varphi_1/8$ and $\varphi_1/8$. The other middle pillar of the conventional U-shaped magnetic core is split into three magnetic pillars respectively with sectional areas of $2S_1/8$, $4S_1/8$ and $2S_1/8$, and the magnetic flux passing through them respectively is $2\varphi_1/8$, 4 $\varphi_1/8$ and $2\varphi_1/8$. The 7 magnetic pillars are arranged as shown in FIG. 4C. It can be seen that the total cross-sectional area and magnetic flux density of the split magnetic pillars are the same with those of the conventional U-shaped magnetic core, but the position of the least magnetic flux of the base portion is reduced to ⅛ of that of the conventional U-shaped magnetic core. Therefore, such design is advantageous for reducing the magnetic flux density of the base portion, and is advantageous for reducing the magnetic loss and thickness of the base portion, and is suitable for the design of the ultra-thin magnetic component and the design of the lightweight structure.

Further, in an embodiment of the present disclosure, as shown in FIG. 5, the spacing between the respective magnetic pillars are equal, which is advantageous for reducing the resistance of the winding and reducing the coil loss.

In one embodiment of the present disclosure, the magnetic device may be provided with an air gap, and specifically, the magnetic device may be provided with the air gap on a magnetic path perpendicular to the base portion or a magnetic path paralleled to the base portion. In detail, at least a portion of the plurality of magnetic pillars are provided air gaps on the magnetic path perpendicular to the base portion, or air gaps are formed between at least a portion of the magnetic pillars and the first surface 100 of the base portion 10. Generally, there is diffusion magnetic flux near the air gap, the diffusion magnetic flux will cause eddy current loss of the nearby coil, and the larger the air gap is, the stronger the diffusion magnetic flux is, and the greater the eddy current loss of the nearby coil will be caused. The magnetic core of the present disclosure has a plurality of magnetic pillars, thus the total air gap can be dispersed to the plurality of magnetic pillars to form a distributed air gap, and each air gap on the magnetic pillar becomes smaller, thereby greatly reducing the diffusion flux, thus reducing the eddy current loss. On the other hand, at least a part of the magnetic pillars are provided with air gaps or at least one base portion is provided with an air gap on the magnetic path paralleled to the base portion. That is, both the magnetic pillar and the base portion can be combined by several parts, and such structure has advantages in high power applications.

In the magnetic device of the present disclosure, the winding is disposed among the magnetic pillars. The winding comprises a first coil 2, and in the case where a current flows through the first coil 2, the magnetic flux directions of adjacent two magnetic pillars are opposite to each other, and the magnetic flux of the respective magnetic pillars conforms to the above-described rule. The winding manner in the present disclosure will be described below by taking the magnetic device shown in FIG. 2 as an example.

Figure 8:
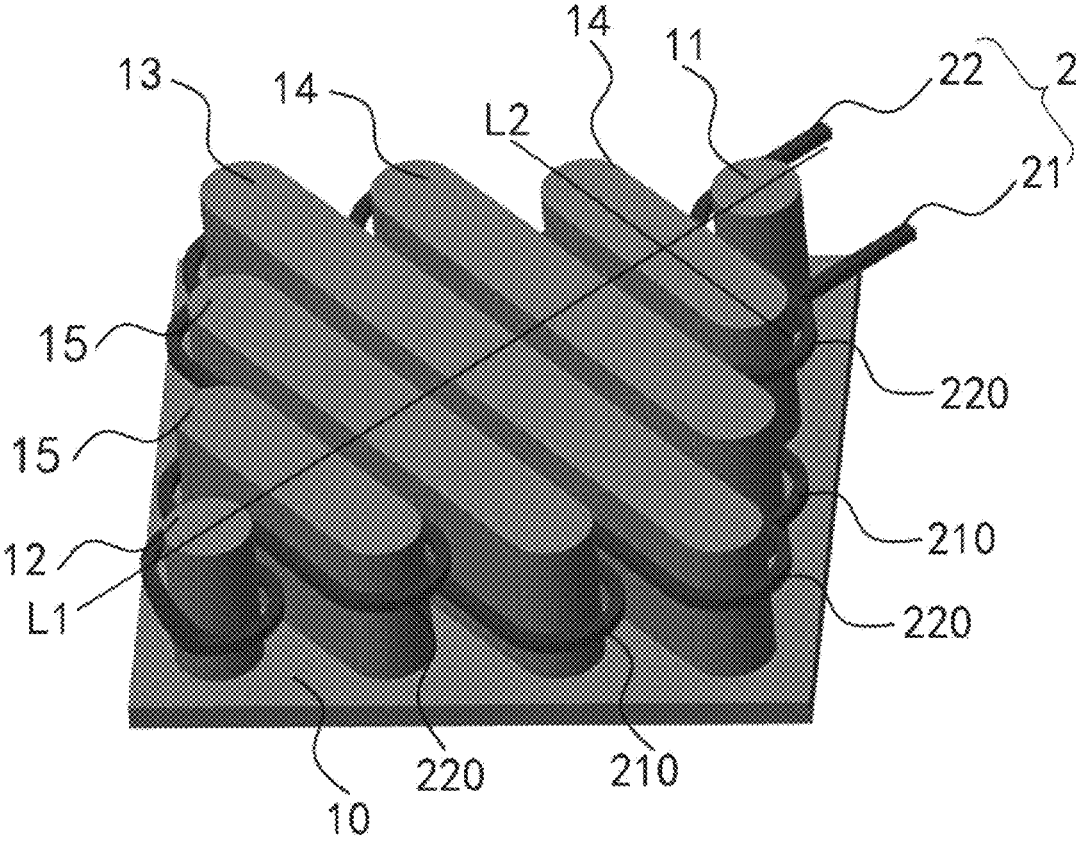
FIG. 8 is a schematic view of a winding manner of a first coil in an embodiment of the magnetic device of the present disclosure.
Figure 14:
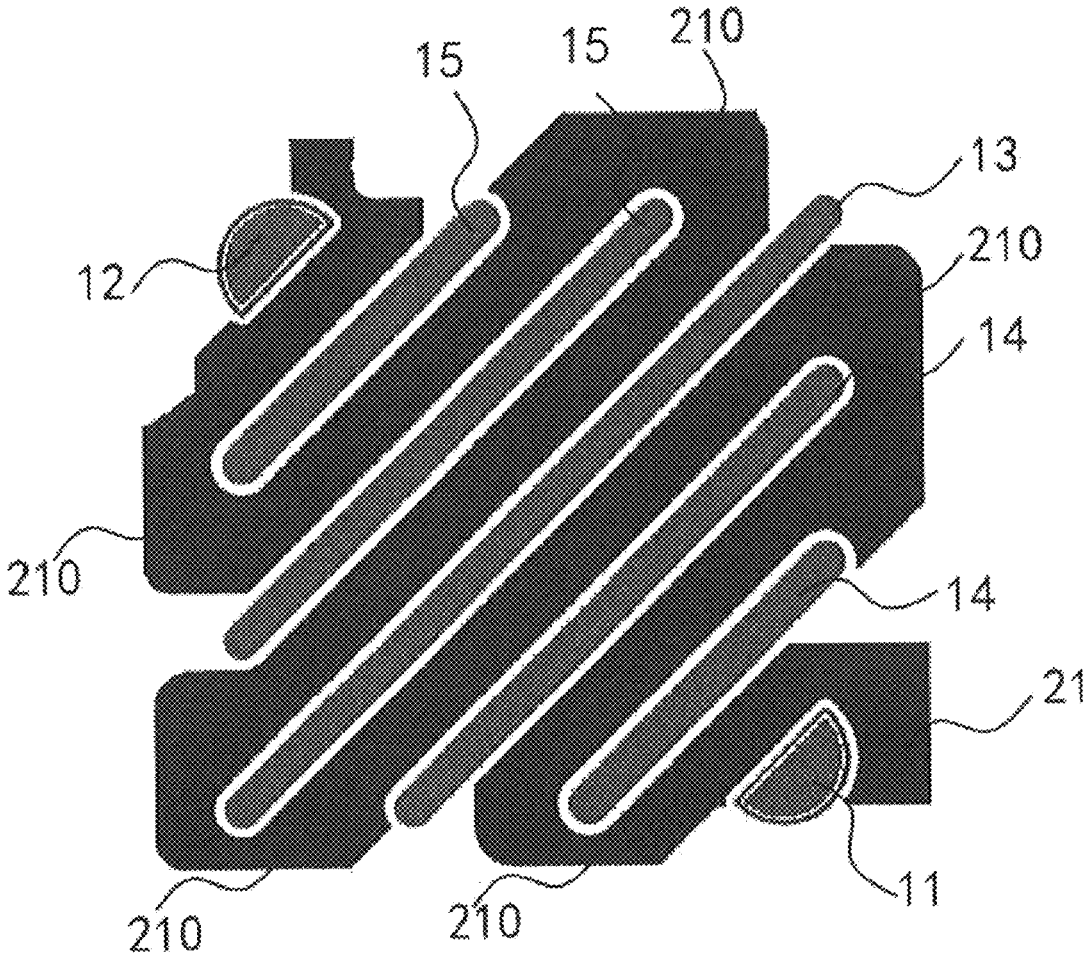
FIG. 14 is a schematic view of a circuit plate wiring of the winding manner shown in FIG. 8.

Referring to FIGS. 8 and 14, FIG. 8 is a schematic view of a winding manner in an embodiment of the magnetic device of the present disclosure. As shown in FIG. 8, the first coil 2 comprises a first winding portion 21 and a second winding portion 22 in series, and the first winding portion 21 and the second winding portion 22 are respectively located in two winding layers paralleled to each other. For the convenience of the following description, the direction paralleled to the longitudinal centerline of any one center pillar is defined as the second direction L2. The first winding portion 21 is winded from the first corner pillar 11, winded along the second direction L2, and sequentially passes by every magnetic pillar until to the second corner pillar 12. The first winding portion 21 is bent 180 degrees at a first end or a second end of each of the winded magnetic pillars in the second direction L2, to form a first bending portion 210. The second winding portion 22 is winded from the second corner pillar 12, winded along the second direction L2, and sequentially passes by every magnetic pillar until to the first corner pillar 11. The second winding portion 22 is bent 180 degrees at the first end or the second end of each of the winded magnetic pillars in the second direction L2, to form a second bending portion 220. The first coil 2 is winded and passes by all the magnetic pillars. It should be noted that "along the second direction L2" is only indicated the general direction of the winding, and it does not mean that the winding is completely paralleled with the second direction L2.

Figure 9:
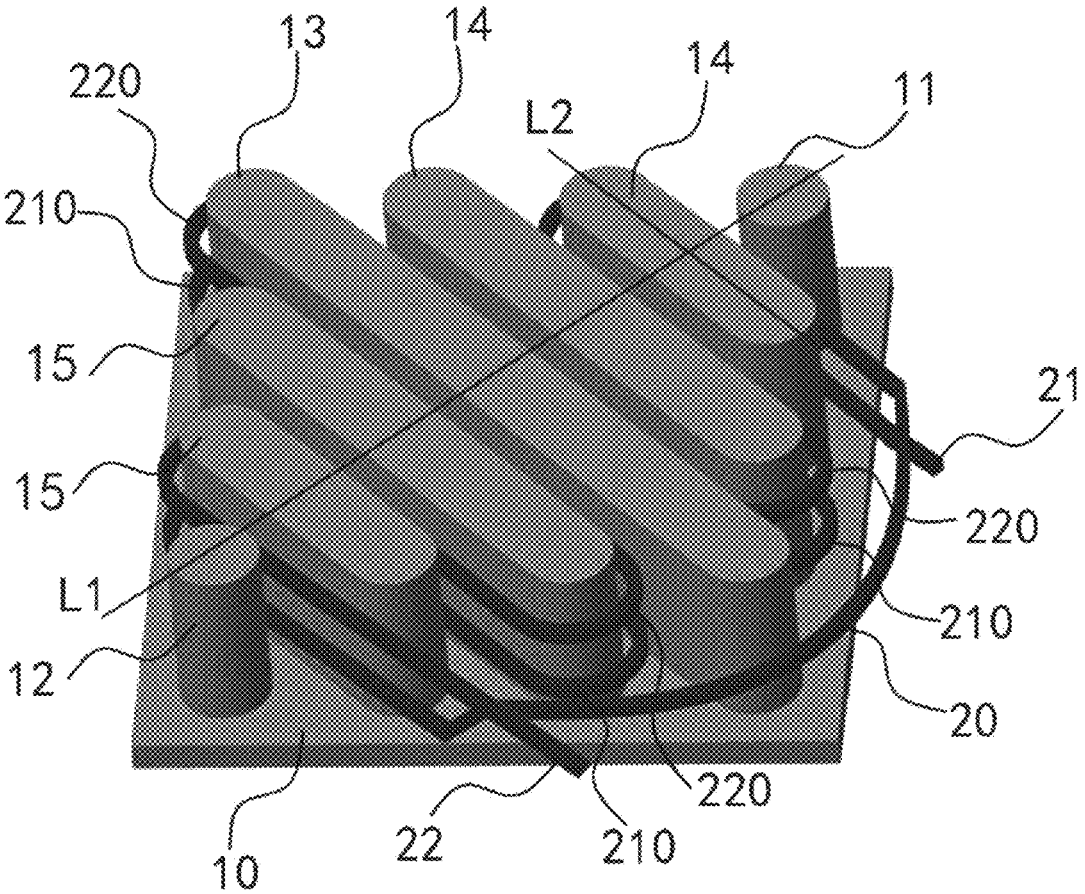
FIG. 9 is a schematic view of a winding manner of a first coil in an embodiment of the magnetic device of the present disclosure.

Referring to FIG. 9, FIG. 9 is a schematic view of a winding manner in an embodiment of the magnetic device of the present disclosure. As shown in FIG. 9, the first coil 2 comprises a first winding portion 21 and a second winding portion 22 in series. The first winding portion 21 and the second winding portion 22 are located in two paralleled winding layers respectively. In some other embodiments, the first winding portion 21 and the second winding portion 22 may be located in the same winding layer as well.

Both the first winding portion 21 and the second winding portion 22 are winded from the first corner pillar 11, winded along the second direction L2, and sequentially pass by every magnetic pillar until to the second corner pillar 12. An outgoing end of the first winding portion 21 and an incoming end of the second winding portion 22 are connected via a connecting portion 20, and the connecting portion 20 is located outside the plurality of magnetic pillars. The first winding portion 21 is bent 180 degrees at a first end or a second end of each of the winded magnetic pillars in the second direction L2, to form a first bending portion 210. The second winding portion 22 is bent 180 degrees at the first end or the second end of each of the winded magnetic pillars in the second direction L2, to form a second bending portion 220.

Figure 10:
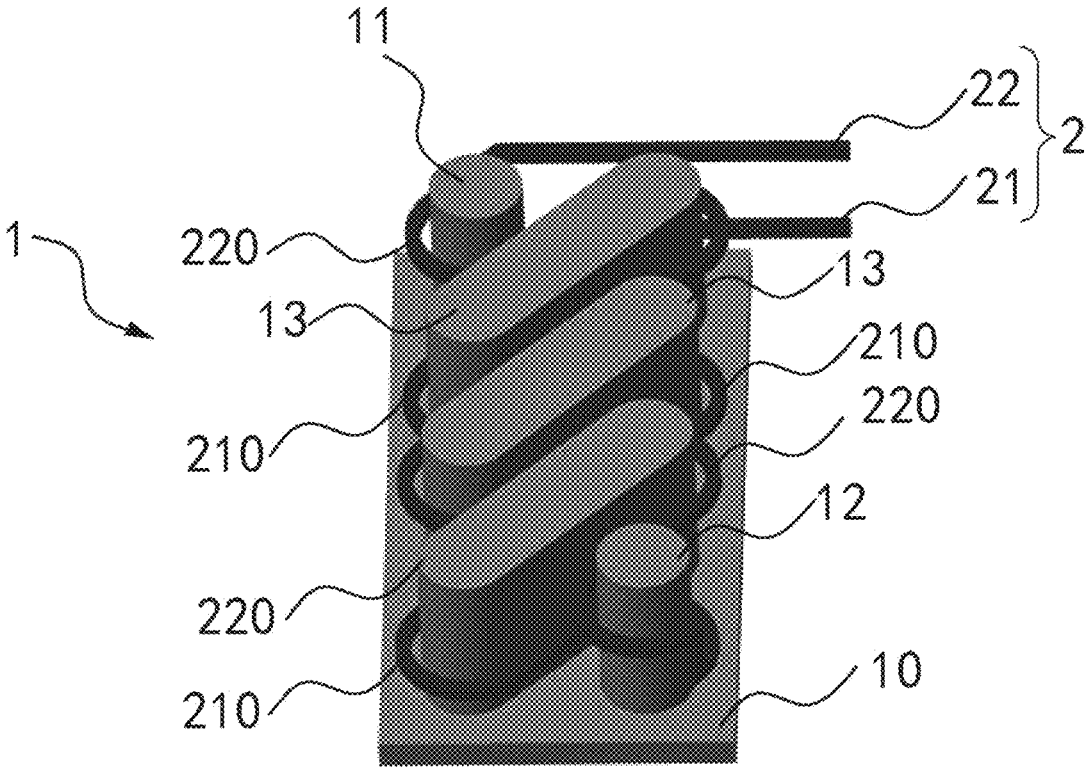
FIG. 10 is a schematic view of a winding manner of the first coil in an embodiment of the magnetic device of the present disclosure.

Referring to FIG. 10, FIG. 10 is a schematic view of a winding manner in an embodiment of the magnetic device of the present disclosure. Similarly to FIG. 8, the first coil 2 comprises a first winding portion 21 and a second winding portion 22 in series, and the first winding portion 21 and the second winding portion 22 are located in two paralleled winding layers respectively. The first winding portion 21 is winded from the first corner pillar 11, winded along the second direction L2, and sequentially passes by every magnetic pillar until to the second corner pillar 12. The first winding portion 21 is bent 180 degrees at a first end or a second end of each of the winded magnetic pillars in the second direction L2, to form a first bending portion 210. The second winding portion is winded from the second corner pillar 12, winded along the second direction L2, and sequentially passes by every magnetic pillar until to the first corner pillar 11. The second winding portion 22 is bent 180 degrees at the first end or the second end of each of the winded magnetic pillars in the second direction L2, to form a second bending portion 220. All the magnetic pillars are surrounded by the first coil 2.

Figure 11:
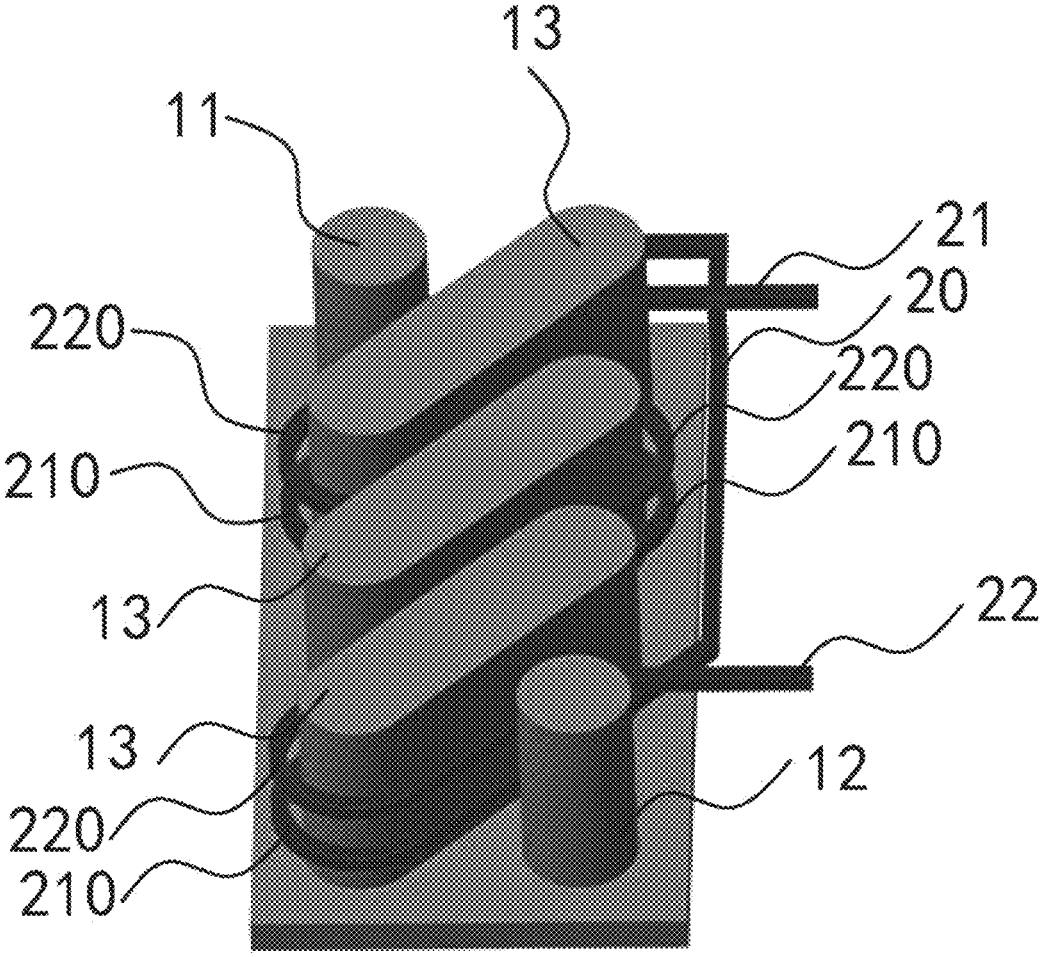
FIG. 11 is a schematic view of a winding manner of the first coil in an embodiment of the magnetic device of the present disclosure.

Referring to FIG. 11, FIG. 11 is a schematic view of a winding manner in an embodiment of the magnetic device of the present disclosure. Similarly to FIG. 9, the first coil 2 comprises a first winding portion 21 and a second winding portion 22 in series. The first winding portion 21 and the second winding portion 22 are respectively located in two paralleled winding layers, or may be located in the same winding layer. Both the first winding portion 21 and the second winding portion 22 are winded from the first corner pillar 11, winded along the second direction L2, and sequentially pass by every magnetic pillar until to the second corner pillar 12. An outgoing end of the first winding portion 21 and an incoming end of the second winding portion 22 are connected via a connecting portion 20, and the connecting portion 20 is located outside the plurality of magnetic pillars. The first winding portion 21 is bent 180 degrees at a first end or a second end of each of the winded magnetic pillars in the second direction L2, to form a first bending portion 210. The second winding portion 22 is bent 180 degrees at the first end or the second end of each of the winded magnetic pillars in the second direction L2, to form a second bending portion 220.

When the magnetic device of the present disclosure is used as a transformer, the winding further comprises a second coil 3, and various winding manners of the second coil 3 in the magnetic device of the present disclosure are exemplified below.

Figure 12:
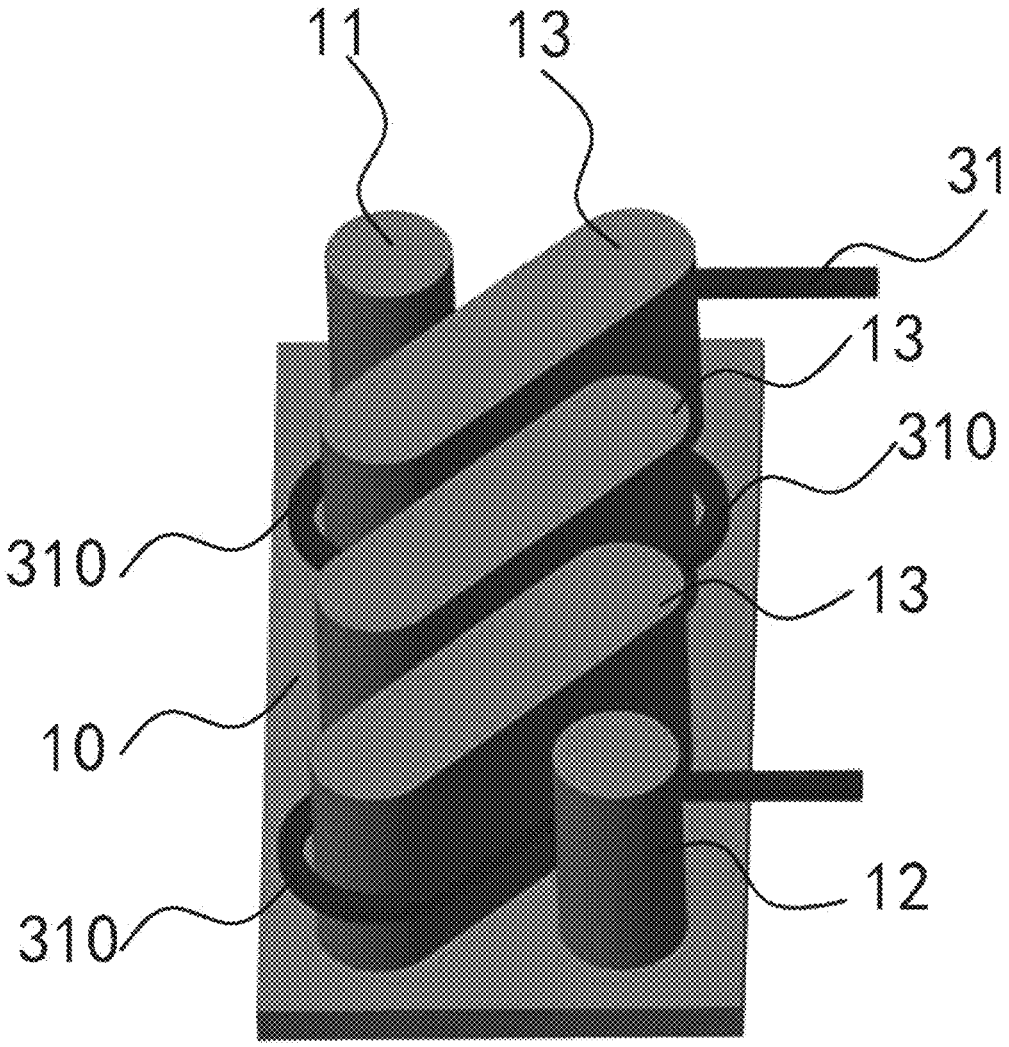
FIG. 12 is a schematic view of a winding manner of a second coil in an embodiment of the magnetic device of the present disclosure.

As shown in FIG. 12, the second coil 3 comprises a third winding portion 31. Similarly to the winding manner of the first winding portion 21 of the first coil 2 shown in FIG. 11. The third winding portion 31 is winded from the first corner pillar 11, winded along the second direction L2, and sequentially passes by every magnetic pillar until to the second corner pillar 12.

Figure 13:
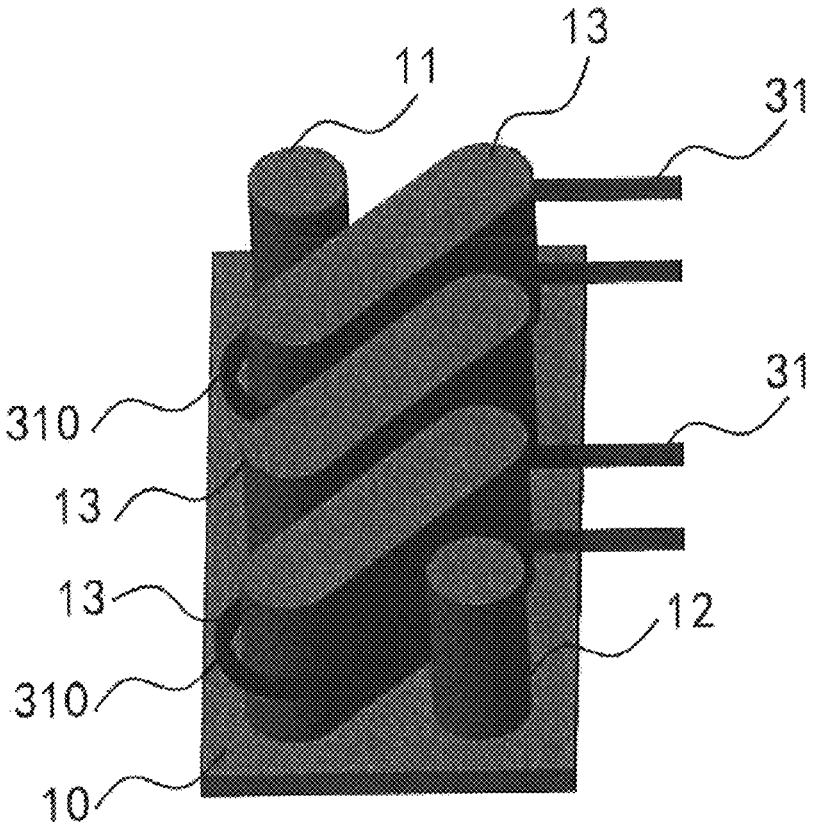
FIG. 13 is a schematic view of a winding manner of a second coil in an embodiment of the magnetic device of the present disclosure.

Referring to FIG. 13, the second coil 3 comprises a plurality of third winding portions 31, and each of the third winding portions 31 is winded around one center pillar 13, and forms a third bending portion 310 at an end of the center pillar 13. It should be noted that, in some embodiments of the present disclosure, the plurality of third winding portions 31 may be respectively winded on a plurality of magnetic pillars with the same magnetic flux, and the magnetic pillars may be the center pillars 13, the first middle pillars 14 and the second middle pillars 15, or the first corner pillar 11 and the second corner pillar 12. On the other hand, the plurality of third winding portions 31 can be coupled in parallel according to the actual need of circuit.

Referring to FIG. 14, FIG. 14 is a schematic view of the circuit board wiring of the winding manner shown in FIG. 8, in which only the first winding portion 21 is shown, and the first winding portion 21 is a wiring in a circuit board 30. In the case where the magnetic device has the second winding portion 22, the second winding portion 22 and the first winding portion 21 may be located in different layers, and the second winding portion 22 and the first winding portion 21 may be connected by via holes. It should be noted that the present disclosure is not limited thereto. For example, the first winding portion 21 and the second winding portion 22 may be wires winded on the magnetic pillars, or may be the copper foil.

Figure 15:
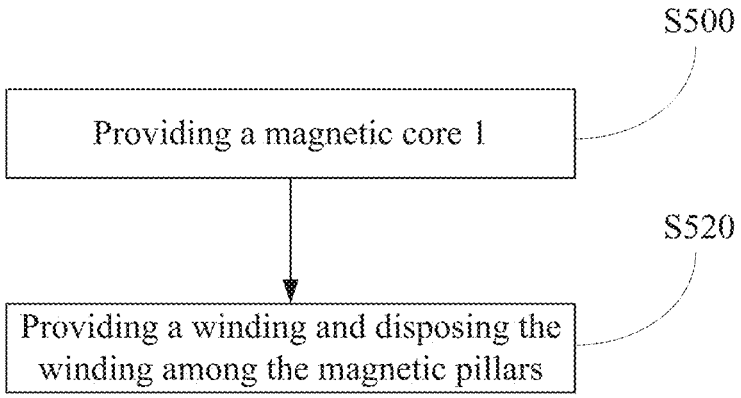
FIG. 15 is a flow chart of a method of manufacturing the magnetic device in an embodiment of the present disclosure.

The present disclosure further provides a method of manufacturing a magnetic device. FIG. 15 is a flow chart of a method of manufacturing the magnetic device in an embodiment of the present disclosure. Combining the aforesaid FIG. 2A—FIG. 14, as shown in FIG. 15, the method of manufacturing the magnetic device in an embodiment of the present disclosure comprises:

step S500, providing a magnetic core 1, wherein the magnetic core 1 comprises:

two base portions 10, each of the two base portions 10 has a first surface 100 and the two first surfaces 100 of the two base portions 10 are faced to each other, and a plurality of magnetic pillars, disposed between the two first surfaces 100 along a first direction L1, and wherein, in the first direction L1, the two magnetic pillars located at the outermost side of the base portion 10 are the first corner pillar 11 and the second corner pillar 12 respectively. The n magnetic pillars having the same cross-sectional area and located at the center position of the base portion 10 are the n center pillars 13, the n center pillars constitute a center pillar unit, m of the magnetic pillars located between the first corner pillar 11 and the center pillar unit are first middle pillars 14 which constitute a first middle pillar unit, and m of the magnetic pillars located between the second corner pillar 12 and the center pillar unit are second middle pillars 15 which constitute a second middle pillar unit, wherein n is an integer greater than or equal to 1, m is an integer greater than or equal to zero, and the cross-sectional area of the magnetic pillars are gradually increased from the first corner pillar 11 to the center pillar 13 closest to the first corner pillar 11, and from the second corner pillar 12 to the center pillar 13 closest to the second corner pillar 12.

In an embodiment, the cross-sectional area of the magnetic pillars are gradually increased in an arithmetic progression from the first corner pillar 11 to the center pillar 13 closest to the first corner pillar 11, and from the second corner pillar 12 to the center pillar 13 closest to the second corner pillar 12.

On a plane paralleled to the first surface 100, the cross-sectional area of both the first corner pillar 11 and the second corner pillar 12 is S, the cross-sectional area of the $k^{th}$ first middle pillar 14 close to the first corner pillar 11 is (k+1)*S, and the cross-sectional area of the $k^{th}$ second middle pillar 15 close to the second corner pillar 12 is (k+1)*S, and the cross-sectional area of each of the center pillars 13 is (m+2)*S, wherein k is an integer greater than or equal to zero, and the cross-sectional area is produced by a section paralleled to the first surface 100.

In an embodiment, the method of manufacturing a magnetic device further comprises:

Step S520, providing a winding and disposing the winding among the magnetic pillars, wherein the winding comprises the first coil 2, and in the case when a current flows through the first coil 2, the magnetic flux directions of adjacent two magnetic pillars are opposite to each other. If the magnetic flux of both the first corner pillar 11 and the second corner pillar 12 is φ, the magnetic flux of the $k^{th}$ first middle pillar 14 close to the first corner pillar 11 is (k+1)*φ, the magnetic flux of the $k^{th}$ second middle pillar 15 close to the second corner pillar 12 is (k+1)*φ, and the magnetic flux of each of the center pillars 13 is (m+2)*φ.

In an embodiment, the first coil 2 comprises the first winding portion 21 and the second winding portion 22 connected in series. The step of forming the first coil 2 is substantially the same as the winding forming manner shown in FIGS. 8 and 9, and will not be repeated herein again.

When the magnetic device of the present disclosure is used as a transformer, the winding further comprises a second coil 3, and the step of forming the second coil 3 is substantially the same as the winding forming manner shown in FIGS. 10 to 13, and will not be repeated herein again.

In the above embodiments, relative terms such as "upper" or "lower" may be used to describe the relative relationship of one component of the reference numeral to another component. It will be understood that if the apparatus of the reference numeral is flipped upside down, the component described "upper" will become the component "lower". The terms "comprising", "including" and "having" are used to denote the meaning of the openly including and are meant to include additional components and the like in addition to the listed components.

It should be understood that the present disclosure does not limit its application to the detailed structure and arrangement of the components presented herein. The present disclosure can have other embodiments, and can be implemented and executed in a variety of manners. The foregoing variations and modifications are intended to fall within the scope of the present disclosure. It should be understood that the disclosure disclosed and claimed herein extends to all alternative combinations of two or more of the independence features mentioned and/or apparent in the specification or accompanying drawings. All of these different combinations constitute a number of alternative aspects of the present disclosure. The embodiments described herein illustrate the best mode known for carrying out the present disclosure and will enable those skilled in the art to utilize the disclosure.

What is claimed is:

1. A magnetic device, comprising:

two base portions, wherein each of the two base portions has a first surface and the two first surfaces of the two base portions are faced to each other, a plurality of magnetic pillars, disposed between the two first surfaces of the two base portions along a first direction, and a winding, disposed among the magnetic pillars, wherein the winding comprises a first coil, and if a current flows through the first coil, the magnetic flux directions of adjacent two of the magnetic pillars are opposite to each other, wherein, in the first direction, two of the magnetic pillars located at the outermost side of the base portion are a first corner pillar and a second corner pillar respectively, n of the magnetic pillars having the same cross-sectional area and located at the center position of the base portion are n center pillars, and the n center pillars constitute a center pillar unit, m of the magnetic pillars located between the first corner pillar and the center pillar unit are first middle pillars which constitute a first middle pillar unit, and m of the magnetic pillars located between the second corner pillar and the center pillar unit are second middle pillars which constitute a second middle pillar unit, wherein n is an integer greater than or equal to 1, m is an integer greater than or equal to zero, and cross-sectional area of the magnetic pillars are gradually increased from the first corner pillar to the center pillar closest to the first corner pillar, and from the second corner pillar to the center pillar closest to the second corner pillar.

2. The magnetic device of claim 1 wherein the cross-sectional area of the magnetic pillars are gradually increased in an arithmetic progression from the first corner pillar to the center pillar closest to the first corner pillar, and from the second corner pillar to the center pillar closest to the second corner pillar, if the cross-sectional area of both the first corner pillar and the second corner pillar are S, the cross-sectional area of the $k^{th}$ first middle pillar close to the first corner pillar is (k+1)*S, the cross-sectional area of the $k^{th}$ second middle pillar close to the second corner pillar is (k+1)*S, and the cross-sectional area of each of the center pillars is (m+2)*S, wherein k is an integer greater than or equal to zero, and the cross-sectional area is produced by a section paralleled to the first surface.

3. The magnetic device of claim 2, wherein, if the magnetic flux of both the first corner pillar and the second corner pillar is φ, the magnetic flux of a $k^{th}$ first middle pillar close to the first corner pillar is (k+1)*φ, the magnetic flux of a $k^{th}$ second middle pillar close to the second corner pillar is (k+1)*φ, and the magnetic flux of each of the center pillars is (m+2)*φ.

4. The magnetic device of claim 2, wherein longitudinal centerlines of the center pillars, the first middle pillars and the second middle pillars are paralleled to each other, and the longitudinal centerlines are intersected with the first direction.

5. The magnetic device of claim 3, wherein the first coil comprises a first winding portion and a second winding portion in series, and the first winding portion and the second winding portion are located in two paralleled winding layers respectively, and the first winding portion is winded from the first corner pillar, winded along a second direction, and sequentially passes by every magnetic pillar until to the second corner pillar, the second winding portion is winded from the second corner pillar, winded along the second direction, and sequentially passes by every magnetic pillar until to the first corner pillar, and the second direction is paralleled with the longitudinal centerlines of the center pillars.

6. The magnetic device of claim 3, wherein the first coil comprises a first winding portion and a second winding portion in series, the first winding portion and the second winding portion are respectively located in two paralleled winding layers or in the same winding layer, and both the first winding portion and the second winding portion are winded from the first corner pillar, winded along a second direction, and sequentially pass by every magnetic pillar until to the second corner pillar, an outgoing end of the first winding portion and an incoming end of the second winding portion are connected via a connecting portion, the connecting portion is located outside the plurality of magnetic pillars, and the second direction is paralleled with the longitudinal centerlines of the center pillars.

7. The magnetic device of claim 3, wherein the plurality of magnetic pillars are arranged with equal spacing between two adjacent magnetic pillars.

8. The magnetic device of claim 5, wherein the first winding portion is bent 180 degrees at a first end or a second end of each of the magnetic pillars in the second direction, to form a first bending portion, and the second winding portion is bent 180 degrees at the first end or the second end of each of the magnetic pillars in the second direction, to form a second bending portion.

9. The magnetic device of claim 1, wherein the magnetic device is an inductor.

10. The magnetic device of claim 5, wherein the magnetic device is a transformer, the winding further comprises a second coil, the second coil comprises a third winding portion, the third winding portion is winded from the first corner pillar, winded along the second direction, and sequentially passes by every magnetic pillar until to the second corner pillar.

11. The magnetic device of claim 5, wherein the magnetic device is a transformer, the winding further comprises a second coil, the second coil comprises a plurality of third winding portions, and the plurality of third winding portions are respectively winded on a plurality of the magnetic pillars with the same magnetic flux.

12. The magnetic device of claim 11, wherein the plurality of third winding portions are coupled in parallel.

13. The magnetic device of claim 1, wherein the cross-sectional shapes of the first corner pillar and the second corner pillar are triangular, semi-circular or elliptical, and the cross-sectional shape of each of the center pillars, the first middle pillars and the second middle pillars is one of the following three shapes: oval, rectangle or racetrack shape.

14. The magnetic device of claim 1, wherein the magnetic device has an air gap on a magnetic path perpendicular to the base portion.

15. The magnetic device of claim 1, wherein the magnetic pillars and/or the base portion have an air gap on a magnetic path paralleled to the base portion.

16. A method of manufacturing a magnetic device, comprising:

providing a magnetic core, wherein the magnetic core comprises:

two base portions, wherein each of the two base portions has a first surface and the two first surfaces of the two base portions are faced to each other, a plurality of magnetic pillars, disposed between the two first surfaces of the two base portions along a first direction, and a winding, disposed among the magnetic pillars, wherein the winding comprises a first coil, and if a current flows through the first coil, the magnetic flux directions of adjacent two of the magnetic pillars are opposite to each other, wherein, in the first direction, two of the magnetic pillars located at the outermost side of the base portion are a first corner pillar and a second corner pillar respectively, n of the magnetic pillars having the same cross-sectional area and located at the center position of the base portion are n center pillars, and the n center pillars constitute a center pillar unit, m of the magnetic pillars located between the first corner pillar and the center pillar unit are first middle pillars which constitute a first middle pillar unit, and m of the magnetic pillars located between the second corner pillar and the center pillar unit are second middle pillars which constitute a second middle pillar unit, wherein n is an integer greater than or equal to 1, m is an integer greater than or equal to zero, and cross-sectional area of the magnetic pillars are gradually increased from the first corner pillar to the center pillar closest to the first corner pillar, and from the second corner pillar to the center pillar closest to the second corner pillar.

17. The method of claim 16, wherein the cross-sectional area of the magnetic pillars are gradually increased in an arithmetic progression from the first corner pillar to the center pillar closest to the first corner pillar, and from the second corner pillar to the center pillar closest to the second corner pillar, if the cross-sectional area of both the first corner pillar and the second corner pillar are S, the cross-sectional area of the $k^{th}$ first middle pillar close to the first corner pillar is (k+1)*S, the cross-sectional area of the $k^{th}$ second middle pillar close to the second corner pillar is (k+1)*S, and the cross-sectional area of each of the center pillars is (m+2)*S, wherein k is an integer greater than or equal to zero, and the cross-sectional area is produced by a section paralleled to the first surface.

18. The method of claim 17, wherein, if the magnetic flux of both the first corner pillar and the second corner pillar is φ, the magnetic flux of a $k^{th}$ first middle pillar close to the first corner pillar is (k+1)*φ, the magnetic flux of a $k^{th}$ second middle pillar close to the second corner pillar is (k+1)*φ, and the magnetic flux of each of the center pillars is (m+2)*φ.

19. The method of claim 18, wherein the first coil comprises a first winding portion and a second winding portion connected in series, and the step of forming the first coil comprises:

the first winding portion is winded from the first corner pillar, winded along a second direction, and sequentially passes by every magnetic pillar until to the second corner pillar, the second winding portion is winded from the second corner pillar, winded along the second direction, and sequentially passes by every magnetic pillar until to the first corner pillar, and the second direction is paralleled with the longitudinal centerlines of the center pillars.

20. The method of claim 18, wherein the first coil comprises a first winding portion and a second winding portion connected in series, and the step of forming the first coil comprises:

both the first winding portion and the second winding portion are winded from the first corner pillar, winded along a second direction, and sequentially pass by every magnetic pillar until to the second corner pillar, an outgoing end of the first winding portion and an incoming end of the second winding portion are connected via a connecting portion, the connecting portion is located outside the plurality of magnetic pillars, and the second direction is paralleled with the longitudinal centerlines of the center pillars.

21. The method of claim 19, wherein the magnetic device is a transformer, the winding further comprises a second coil, the second coil comprises a third winding portion, the third winding portion is winded from the first corner pillar, winded along the second direction, and sequentially passes by every magnetic pillar until to the second corner pillar.

22. The method of claim 19, wherein the magnetic device is a transformer, the winding further comprises a second coil, the second coil comprises a plurality of third winding portions, and the plurality of third winding portions are respectively winded on a plurality of the magnetic pillars with the same magnetic flux.

23. The method of claim 22, wherein the plurality of third winding portions are coupled in parallel.

* * * * *